US009584934B2

(12) United States Patent
Kim et al.

(10) Patent No.: US 9,584,934 B2
(45) Date of Patent: Feb. 28, 2017

(54) HEARING DEVICE AND METHOD FOR FITTING HEARING DEVICE

(71) Applicant: Samsung Electronics Co., Ltd., Suwon-si (KR)

(72) Inventors: Sang Wook Kim, Seoul (KR); Jong Min Choi, Seoul (KR); Dong Wook Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 303 days.

(21) Appl. No.: 14/227,118

(22) Filed: Mar. 27, 2014

(65) Prior Publication Data

US 2015/0049876 A1 Feb. 19, 2015

(30) Foreign Application Priority Data

Aug. 19, 2013 (KR) ..... 10-2013-0097721

(51) Int. Cl.
*H04R 25/00* (2006.01)

(52) U.S. Cl.
CPC ..... *H04R 25/70* (2013.01); *H04R 25/552* (2013.01)

(58) Field of Classification Search
CPC ..... H04R 25/70; H04R 25/552; H04R 25/30; H04R 25/50; H04R 2225/41; H04R 2225/43; H04S 2420/01
USPC ..... 381/60, 23.1, 314, 320, 321
See application file for complete search history.

(56) References Cited

U.S. PATENT DOCUMENTS

| | | | | |
|---|---|---|---|---|
| 2002/0176584 | A1 | 11/2002 | Kates | |
| 2003/0063763 | A1 | 4/2003 | Allred et al. | |
| 2009/0116657 | A1* | 5/2009 | Edwards | H04R 25/552 381/60 |
| 2011/0075853 | A1* | 3/2011 | Anderson | A61B 5/11 381/60 |
| 2013/0051566 | A1* | 2/2013 | Pontoppidan | H04R 25/353 381/23.1 |

* cited by examiner

*Primary Examiner* — Alexander Jamal
(74) *Attorney, Agent, or Firm* — NSIP Law

(57) ABSTRACT

A hearing device and a method for fitting the hearing device are provided. The method for fitting a monaural hearing device involve obtaining audiograms of both ears, and adjusting an amplification gain based on the audiograms of both ears, in which the audiograms comprise an audiogram of a first ear for wearing the monaural hearing device and an audiogram of a second ear not wearing the monaural hearing device.

13 Claims, 8 Drawing Sheets

FIG. 4A (a) Audio grams

| Frequency | L-audiogram | R-audiogram |
|---|---|---|
| 250 | 20 | 20 |
| 500 | 20 | 20 |
| 1000 | 25 | 20 |
| 2000 | 35 | 25 |
| 4000 | 45 | 25 |
| 6000 | 60 | 30 |

(b) Directivity Fitting Table for Left Ear

| 2kHz | | Input level (right, dB) | | | | | | | | |
|---|---|---|---|---|---|---|---|---|---|---|
| Left | | 10 | 20 | 30 | 40 | 50 | 60 | 70 | 80 | 90 |
| Input level (left, dB) | 10 | 18 | 18 | 18 | – | – | – | – | – | – |
| | 20 | 17 | 16 | 16 | 15 | – | – | – | – | – |
| | 30 | 15 | 14 | 13 | 12 | 11 | – | – | – | – |
| | 40 | – | 13 | 12 | 12 | 11 | 10 | – | – | – |
| | 50 | – | – | 11 | 11 | 11 | 10 | 9 | – | – |
| | 60 | – | – | – | 10 | 10 | 10 | 9 | 7 | – |
| | 70 | – | – | – | – | 9 | 9 | 8 | 7 | 5 |
| | 80 | – | – | – | – | – | 7 | 7 | 5 | 4 |
| | 90 | – | – | – | – | – | – | 5 | 3 | 2 |

FIG. 4B

Directivity Fitting Table for Right Ear

| 2kHz | | Input level (right, dB) | | | | | | | | |
|---|---|---|---|---|---|---|---|---|---|---|
| Right | | 10 | 20 | 30 | 40 | 50 | 60 | 70 | 80 | 90 |
| Input level (left, dB) | 10 | 17 | 17 | 17 | – | – | – | – | – | – |
| | 20 | 16 | 14 | 14 | 14 | – | – | – | – | – |
| | 30 | 14 | 12 | 12 | 11 | 11 | – | – | – | – |
| | 40 | – | 11 | 10 | 10 | 10 | 10 | – | – | – |
| | 50 | – | – | 11 | 9 | 9 | 8 | 8 | – | – |
| | 60 | – | – | – | 9 | 9 | 8 | 8 | 7 | – |
| | 70 | – | – | – | – | 8 | 8 | 9 | 7 | 5 |
| | 80 | – | – | – | – | – | 7 | 7 | 5 | 4 |
| | 90 | – | – | – | – | – | – | 5 | 3 | 2 |

HEARING DEVICE AND METHOD FOR FITTING HEARING DEVICE

CROSS-REFERENCE TO RELATED APPLICATION(S)

This application claims the benefit under 35 USC 119(a) of Korean Patent Application No. 10-2013-0097721 filed on Aug. 19, 2013, in the Korean Intellectual Property Office, the entire disclosure of which is incorporated herein by reference for all purposes.

BACKGROUND

1. Field

The following description relates to a hearing device and a method for fitting a hearing device using a binaural hearing model.

2. Description of Related Art

A hearing device is used to assist a user wearing the hearing device to hear an ambient sound more clearly. A hearing device receives a sound wave through a microphone, and outputs the received sound wave to a user after processing and amplifying the sound wave.

With the development of integrated circuits (ICs) and hearing device fitting technology, some hearing devices are now capable of providing an amount of gain and a type of output that are appropriate for a type and degree of hearing loss experienced by a patient. Further, the sizes of available hearing devices have been reduced.

Hearing devices are produced in various forms, such as a glasses type hearing device for mounting to a glasses frame, a behind-the-ear (BTE) type hearing device for wearing on an ear, and a completely-in-canal (CIC) type hearing device for mounting inside an ear.

Some hearing devices compensate for the hearing loss of a use by varying the amplification level of sounds at different frequencies. A fitting scheme for a hearing device refers to control of a signal amplification level according to a level of a frequency band and an input signal, in consideration of an auditory threshold, which is an audible limit of a user wearing the hearing device. Thus, the hearing device can be used to help the user to hear a sound better based on the personal need of the user. Recently, researches are underway on more accurate fitting of hearing devices so as to deliver a sound to the users of hearing devices more clearly.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a method for fitting a monaural hearing device, the method involving: obtaining audiograms of both ears, and adjusting an amplification gain based on the audiograms of both ears, in which the audiograms comprise an audiogram of a first ear for wearing the monaural hearing device and an audiogram of a second ear not wearing the monaural hearing device.

The general aspect of the method may further involve obtaining head shape information of a user.

The adjusting of the amplification gain may involve: generating a volume fitting table using the head shape information and the audiogram of the first ear; and adjusting the amplification gain according to the volume fitting table.

The generating of the volume fitting table may involve calculating wide dynamic range compression (WDRC) information using the audiogram of the first ear and generating the volume fitting table using the head shape information and the WDRC information.

The adjusting of the amplification gain may involve: calculating a level difference per frequency band of audio signals perceived by both ears, using the volume fitting table and the audiogram with respect to the second ear; extracting a detection threshold range based on the audiograms with respect to both ears; adjusting the volume fitting table so that the level difference per frequency band is included in the detection threshold range in response to the level difference per frequency band being beyond the detection threshold range; setting the adjusted volume fitting table as a directivity fitting table; and adjusting the amplification gain according to the directivity fitting table.

The calculating may involve calculating the level difference per frequency band using equal loudness information according to the frequency band.

The general aspect of the method may further involve setting an operation mode of the monaural hearing device, and the adjusting of the amplification gain may involve adjusting the amplification gain using the audiograms with respect to both ears when the operation mode is a binaural fitting mode.

In another general aspect, there is provided a method for fitting a binaural hearing device, the method involving: obtaining audiograms of both ears; and adjusting an amplification gain of a first unit of the binaural hearing device for a first ear based on the audiograms of both ear, and the adjusting of the amplification gain of the first unit is based on an audiogram of a second ear for wearing a second unit of the binaural hearing.

The general aspect of the method may further involve obtaining head shape information of the user.

The adjusting of the amplification gain of the first unit may involve: generating a first volume fitting table using the head shape information and the audiogram of the first ear; and controlling the amplification gain according to the first volume fitting table.

The generating of the first volume fitting table may involve: calculating wide dynamic range compression (WDRC) information using the audiogram of the first ear; and generating the first volume fitting table using the head shape information and the WDRC information.

The adjusting of the amplification gain may involve: calculating a level difference per frequency band of audio signals perceived by both ears, using the first volume fitting table and a second volume fitting table that is generated using the head shape information and the audiogram of the second ear; extracting a detection threshold range based on the audiograms with respect to both ears; adjusting the first volume fitting table so that the level difference per frequency band is included in the detection threshold range when the level difference per frequency band is beyond the detection threshold range; setting the adjusted first volume fitting table as a directivity fitting table; and controlling the amplification gain according to the directivity fitting table.

The calculating may involve calculating the level difference per frequency band using equal loudness information according to the frequency band.

The general aspect of the method may further involve: setting an operation mode of the binaural hearing device, and the adjusting of the amplification gain of the first unit comprises adjusting the amplification gain using the audiograms of both ears in response to the operation mode being a binaural fitting mode.

In another general aspect, there is provided a non-transitory computer readable recording medium storing a program to cause a computer to execute the above method.

In yet another general aspect, there is provided a binaural hearing device, the device including: an audiogram obtaining unit configured to obtain audiograms of a first ear and a second ear, a first unit configured to amplify sound for the first ear, a second unit configured to amplify sound for a second ear, and an amplification gain control unit configured to adjust an amplification gain of the first unit based on the audiograms of the first ear and the second ear.

The audiogram obtaining unit may be configured to obtain the audiograms from a device storing the audiograms.

The amplification gain control unit may be configured to adjust the amplification gain by: generating a first volume fitting table for the first ear, generating a second volume fitting table for the second ear, generating a directivity fitting table based on the first volume fitting table and the second volume fitting table, and adjusting the amplification gain based on the directivity fitting table.

The first volume fitting table may be generated based on the audiogram of the first ear and head shape information.

Other features and aspects will be apparent from the following detailed description, the drawings, and the claims.

BRIEF DESCRIPTION OF THE DRAWINGS

FIGS. 4A and 4B are diagrams illustrating an example of a method of generating a directivity fitting table of a binaural hearing device.

Figure 1:
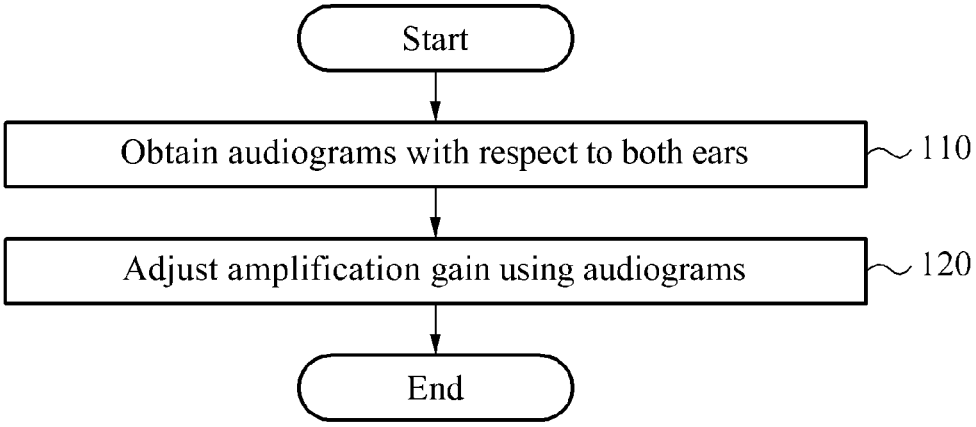
FIG. 1 is a flowchart illustrating an example of a method for fitting a monaural hearing device.

Throughout the drawings and the detailed description, unless otherwise described, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

In the following description, a hearing device may refer to an apparatus that provides an audio signal to a user by being detachably fixed to or closely contacting an ear of the user. A hearing device may include a hearing aid that amplifies an audio signal generated outside and assists the user wearing the hearing aid to perceive the audio signal by delivering the amplified version of the audio signal. A hearing device may include a system that supports a hearing aid function. Examples of such a system include a mobile device, a television (TV), and a consumer electronics/information technology (CE/IT) device, a plug-in accessory or hearing aid module having a sound or broadcasting relay function with respect to a hearing assistance, and a hearing aid chip.

A hearing device may be a monaural device that generates an audio signal at one ear of the user, or a binaural device that generates an audio signal at both ears of the user. A binaural device may include a pair of units or receivers, so that each unit may be paired with an ear of the user.

A hearing device according to one example may operate in a general mode or a binaural fitting mode. The general mode refers to an operation mode for performing a general function of the hearing device, such as a general hearing aid function. The binaural fitting mode refers to an operation mode for obtaining audiograms of a user with respect to both ears of the user and controlling an amplification gain using the audiograms. Hereinafter, a hearing device that operates in the binaural fitting mode will be described.

FIG. 1 illustrates an example of a method for fitting a monaural hearing device.

Referring to FIG. 1, the method for fitting the monaural hearing device may involve obtaining audiograms of a user with respect to both ears of the user, as in 110. The monaural hearing device refers to a hearing device that generates an audio signal at one ear of the user. Thus, the monaural hearing device may include a receiver for one ear. A user may wear the monaural hearing device on either of both ears. In the alternative, the monaural hearing device may be fitted for one ear of the user.

An audiogram refers to a chart showing auditory thresholds of a user with respect to various frequency bands, ranging from a low-pitch sound to a high-pitch sound. An audiogram is sometime depicted as a graph, rather than a chart. An auditory threshold refers to a minimum audible sound level, or the softest sound that an individual can detect. In its graphic form, a vertical axis of the audiogram indicates an intensity of sound expressed by a decibel (dB) while a horizontal axis indicates an audio frequency band.

The audiograms with respect to both ears may include an audiogram with respect to one ear wearing the hearing device and an audiogram with respect to another ear not wearing the hearing device. The user of a monaural hearing device may perceive an audio signal by not only the ear wearing the monaural hearing device, but also through the ear not wearing the monaural hearing device. Therefore, to provide a more accurate audio signal to the user, the monaural hearing device may control an amplification gain in consideration of characteristics of the ear not wearing the monaural hearing device as well as characteristics of the ear wearing the monaural hearing device.

In one example, audiograms with respect to both ears may be generated through a hearing test of the user, and may be stored in a device. The monaural hearing device may receive the generated audiograms with respect to both ears via a wired connection or a wireless connection from the device that is storing the audiogram.

In addition, the monaural hearing device may obtain head shape information about the shape of the head of the user. For example, the head shape information may include a face width, a head width, a head circumference, a distance from a head vertex to both ears, and the like, of the user. Due to a difference in the head shape between different users, audio signals that are generated from the same sound source may have different sensing times or levels. Accordingly, the monaural hearing device may control the amplification gain by factoring in the head shape of the user to deliver more accurate sound to the user. For example, the head shape information may be measured in advance and may be stored in a memory of a device. The monaural hearing device may receive the head shape information via a wired connection or a wireless connection from the device storing the head shape information.

The fitting method for the monaural hearing device may include controlling the amplification gain using the audiograms with respect to both ears, as in 120. The monaural hearing device may fit at least one of a volume and directivity by controlling the amplification gain.

For fitting of the volume, the monaural hearing device may generate a volume fitting table using the head shape information and an audiogram with respect to the ear wearing the monaural hearing device. In this example, the volume fitting table refers to a table showing amplification gains of the monaural hearing device to control a sound volume of the monaural hearing device. The monaural hearing device may, for example, generate the volume fitting table using a fitting formula. For instance, the monaural hearing device may generate the volume fitting table using a linear amplification type fitting formula or a non-linear amplification type fitting formula.

When the non-linear amplification type fitting formula is used, the monaural hearing device may generate the volume fitting table using wide dynamic range compression (WDRC) information. The WDRC method does not uniformly amplify all audio signals but rather amplifies an audio signal that is perceivable by the user by a small degree and an audio signal unperceivable by the user by a large degree. The monaural hearing device may calculate the WDRC information using an audiogram with respect to the ear wearing the monaural hearing device, and generate the volume fitting table using the head shape information and the WDRC information. The monaural hearing device may control the amplification gain according to the volume fitting table.

For fitting of the directivity, the monaural hearing device may calculate a level difference per frequency band or a phase difference per the frequency band of the audio signals perceived by both ears, using the volume fitting table and the audiogram with respect to the ear not wearing the monaural hearing device. When a level difference between an audio signal perceived by a left ear and an audio signal perceived by a right ear is within a detection threshold range according to a position of a source, the user may detect a direction of the source of the audio signal.

A hearing ability of the ear wearing the monaural hearing device may be compensated based on values of the volume fitting table. Accordingly, the monaural hearing device may be designed to compensate for the hearing capability of the ear that is wearing the hearing device in a customized manner. In addition, the monaural hearing device may obtain a hearing ability of the ear not wearing the monaural hearing device, using the audiogram with respect to the ear not wearing the monaural hearing device. Therefore, the level difference per frequency band of the audio signals perceived by both ears may be calculated. In an example, the monaural hearing device may calculate the level difference per frequency band using equal loudness information according to the frequency band. According to the frequency band, audio signals having even the same intensity may be recognized as audio signals of different levels by the user. Thus, the monaural hearing device may calculate the level difference per frequency band using equal loudness information according to the frequency band.

The monaural hearing device may extract the detection threshold range based on the audiograms with respect to both ears. In an example, the monaural hearing device may extract the detection threshold range from a database (DB). The monaural hearing device may include the DB or may be connected with the DB wired or wirelessly.

The monaural hearing device may extract a minimum detection threshold value based on at least one of the audiogram with respect to the ear wearing the monaural hearing device and the audiogram with respect to the ear not wearing the monaural hearing device. Also, the monaural hearing device may extract a maximum detection threshold value based on a most comfortable level (MCL). Here, the monaural hearing device may extract a detection threshold range from the DB, in consideration of an age, a gender, and the like of the user.

When the level difference per frequency band is within the detection threshold range, the monaural hearing device may set the volume fitting table as a directivity fitting table, and control the amplification gain according to the directivity fitting table.

When the level difference per frequency band is beyond the detection threshold range, the monaural hearing device may control the volume fitting table so that the level difference per frequency band is included in the detection threshold range. In an example, when the level difference per frequency band is smaller than the minimum detection threshold value, the monaural hearing device may control the volume fitting table so that the level difference per frequency band becomes larger than the minimum detection threshold value. Also, when the level difference per frequency band is larger than the maximum detection threshold value, the monaural hearing device may control the volume fitting table so that the level difference per frequency band becomes smaller than the maximum detection threshold value. The monaural hearing device may set the controlled volume fitting table as the directivity fitting table and control the amplification gain according to the directivity fitting table.

In addition, in an example, the monaural hearing device may set an operation mode. As aforementioned, the general mode refers to an operation mode for performing a general function of the monaural hearing device whereas the binaural fitting mode refers to an operation mode for obtaining audiograms with respect to both ears and controlling an amplification gain using the audiograms. The monaural hearing device may access the binaural fitting mode as a default or through a user interface (UI). The monaural hearing device may receive an input of the user through the UI. When receiving the input of the user, the monaural hearing device may set the binaural fitting mode as the operation mode.

Here, the UI may include at least one of a predetermined button disposed on at least one of the monaural hearing device and an external device connected to the monaural hearing device through a wired or wireless communication channel, a touch panel of at least one of the monaural hearing device and an external device connected to the monaural hearing device through a wired or wireless communication channel, and a microphone included in the monaural hearing device.

For example, when the predetermined button disposed at the monaural hearing device or a remote controller is pressed in the general mode, the monaural hearing device may set the operation mode to the binaural fitting mode. When the predetermined button disposed at the monaural hearing device is pressed in the binaural fitting mode, the monaural hearing device may set the operation mode to the general mode. As another example, in a state that the monaural hearing device and a mobile device is connected through a wireless communication channel, when a touch input by the user is detected from a touch panel included in the mobile device, the monaural hearing device may set the operation mode to the binaural fitting mode. As yet another example, the monaural hearing device may set the audio signal for entering the binaural fitting mode in advance. When detecting the audio signal using the microphone, the monaural hearing device may compare the detected audio signal with a predetermined audio signal. When the detected audio signal is relatively similar to the predetermined audio signal, the monaural hearing device may set the operation mode to the binaural fitting mode. When the detected audio signal is distinguishable from the predetermined audio signal, the monaural hearing device may set or maintain the general mode.

Figure 2:
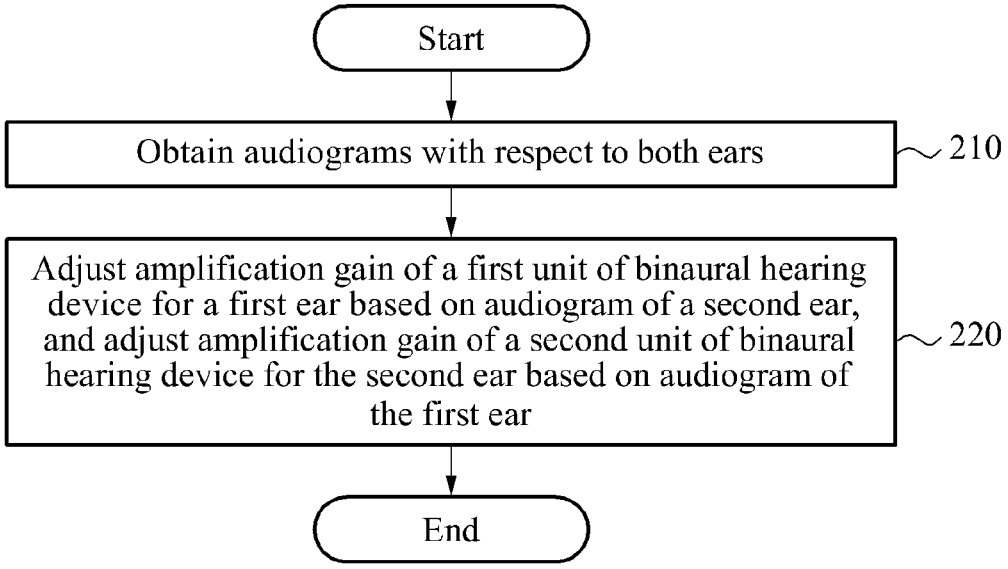
FIG. 2 is a flowchart illustrating an example of a method for fitting a binaural hearing device.

FIG. 2 is a flowchart illustrating an example of a method for fitting a binaural hearing device based on the hearing capability of a user at both ears.

Referring to FIG. 2, the method for fitting the binaural hearing device may include obtaining audiograms of a user with respect to both ears, as in 210. The binaural hearing device refers to a hearing device that generates audio signals at both ears. The user may wear the binaural hearing device so as to place each of its two units on each side of two ears.

The audiograms of both ears include an audiogram of a left ear and an audiogram of a right ear of the user. In order to provide a more accurate audio signal, the binaural hearing device may be fitted by adjusting an amplification gain of a first unit of the binaural hearing device, in consideration of not only an audiogram of the first ear that is wearing a fitting target unit of the binaural hearing device but also in consideration of an audiogram of the second ear wearing a second unit of the binaural hearing device that is not undergoing the fitting.

For example, the audiograms of both ears are may be generated through a hearing test of the user. The binaural hearing device may receive the generated audiograms of both ears through a wired or a wireless connection from a device that is storing the audiograms.

In addition, the binaural hearing device may obtain head shape information about the shape of the head of the user. For example, the head shape information may include a face width, a head width, a head circumference, a distance from a head vertex to both ears, and the like, of the user. In one example, the head shape information may be measured in advance and may be stored in a memory of a device. The binaural hearing device may receive the head shape information via a wired or wireless connection from the device that is storing the head shape information.

To adjust an amplification gain level of a first unit of a binaural hearing device, the method for fitting the binaural hearing device may involve setting the amplification gain level for a first unit of the hearing device for a first ear based on an audiogram of a second ear, as in 220. The units of the binaural hearing device may be fitted based at least one of a volume and a directivity by adjusting the amplification gain level.

To fit the volume of the binaural hearing device, the binaural hearing device may generate a first volume fitting table, based on both the head shape information and an audiogram for the first ear that is wearing the hearing device to adjust the amplification gain. That is, the first volume fitting table may be a table that illustrates the amplification gains of a first unit of the binaural hearing device that is being fitted. In an example, the binaural hearing device may generate the first volume fitting table using a fitting formula. For example, the binaural hearing device may generate the first volume fitting table, using a linear amplification type fitting formula or a non-linear amplification type fitting formula. In the event that the non-linear amplification type fitting formula is used, the binaural hearing device may use WDRC information in generating the first volume fitting table. The binaural hearing device may calculate the WDRC using the audiogram of the first ear wearing the fitting target unit. In addition, the binaural hearing device may generate the first volume fitting table using the head shape information and the WDRC. The binaural hearing device may control the amplification gain according to the generated first volume fitting table.

To fit the directivity, the binaural hearing device may calculate a level difference per frequency band of audio signals perceived by both ears, using the first volume fitting table and a second volume fitting table. The second volume fitting table may be generated using the head shape information and the audiogram with respect to the second ear wearing the second unit other than the fitting target unit of the binaural hearing device. In an example, the second volume fitting table may be generated in advance with the second unit of the hearing device other than the fitting target unit. The binaural hearing device may obtain a compensated hearing ability of the first ear wearing the fitting target unit using the first volume fitting table, and obtain a compensated hearing ability of the second ear wearing the second unit using the second volume fitting table. Accordingly, the binaural hearing device may calculate the level different per frequency band of the audio signals perceived by both ears based on the compensated hearing abilities of both ears. In an example, the binaural hearing device may calculate the level different per frequency band, using equal loudness information according to the frequency band.

The binaural hearing device may extract a detection threshold range based on the audiograms obtained from both ears. In an example, the binaural hearing device may extract the detection threshold range from a database. For example, the binaural hearing device may extract a minimum detection threshold value based on at least one of the audiogram of the first ear wearing the fitting target unit and the audiogram of the second ear wearing the second unit. Also, the binaural hearing device may extract a maximum detection threshold value based on an MCL. Here, the binaural hearing device may extract a detection threshold range from the DB, in consideration of an age, a gender, and the like of the user.

When the level difference per frequency band is within the detection threshold range, the binaural hearing device may set the first volume fitting table as a first directivity fitting table, and may adjust the amplification gain according to the first directivity fitting table.

When the level difference per frequency band is beyond the detection threshold range, the binaural hearing device may control the first volume fitting table so that the level difference per frequency band is included in the detection threshold range. The binaural hearing device may set the first volume fitting table as the first directivity fitting table, and control the amplification gain of the fitting target hearing device according to the first directivity fitting table.

In an example, when fitting the directivity with respect to the second unit other than the fitting target unit of the binaural hearing device, the binaural hearing device may calculate the level difference per frequency band using the first directivity fitting table and the second volume fitting table. The binaural hearing device may extract the detection threshold range based on the audiograms with respect to both ears, and may adjust the second volume fitting table so that the level difference per frequency band is included in the detection threshold range, thereby setting the adjusted second volume fitting table as a directivity fitting table of the other hearing device, that is, a second directivity fitting table. The binaural hearing device may control the amplification gain according to the second directivity fitting table.

In addition, the binaural hearing device may set the operation mode in the same manner as the monaural hearing device. That is, when the operation mode is the general move, the binaural hearing device may perform a general function of the binaural hearing device. When the operation mode is the binaural fitting mode, the binaural hearing device may obtain the audiograms with respect to both ears and adjust the amplification gain using the audiograms.

FIGS. 3A to 3D are diagrams illustrating an example of a method of directivity fitting of a monaural hearing device.

Figure 3A:
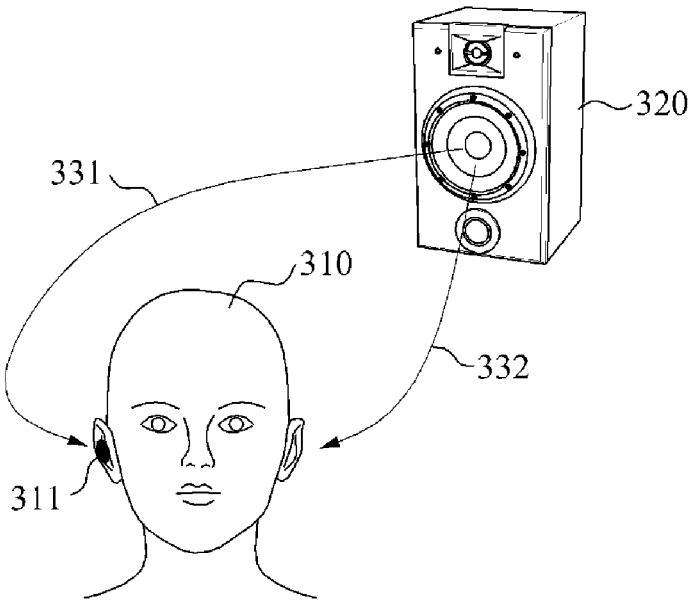
FIGS. 3A to 3D are diagrams illustrating an example of a method of directivity fitting of a monaural hearing device.

Referring to FIG. 3A, a user 310 may be wearing a monaural hearing device 311 on a first ear. The user 310 may perceive audio signals 331 and 332 generated from a source 320 though both ears, that is the first ear with the hearing device 311 and a second ear without the hearing device 311. Under this condition, the monaural hearing device 311 may generate a volume fitting table using the head shape information of the user 310 and an audiogram with respect to the first ear wearing the monaural hearing device 311. The monaural hearing device 311 may calculate a level difference per frequency band or a phase difference per the frequency band of the audio signals perceived by both ears, using the volume fitting table and the audiogram with respect to the second ear without the monaural hearing device 311. Here, the monaural hearing device 311 may calculate the level difference per frequency band using equal loudness information according to the frequency band. When a level difference between the audio signal 332 perceived by the second ear (left ear) and the audio signal 331 perceived by the first ear (right ear) is within a detection threshold range according to a position of the source 320, the user may detect a direction of the source 320.

Figure 3B:
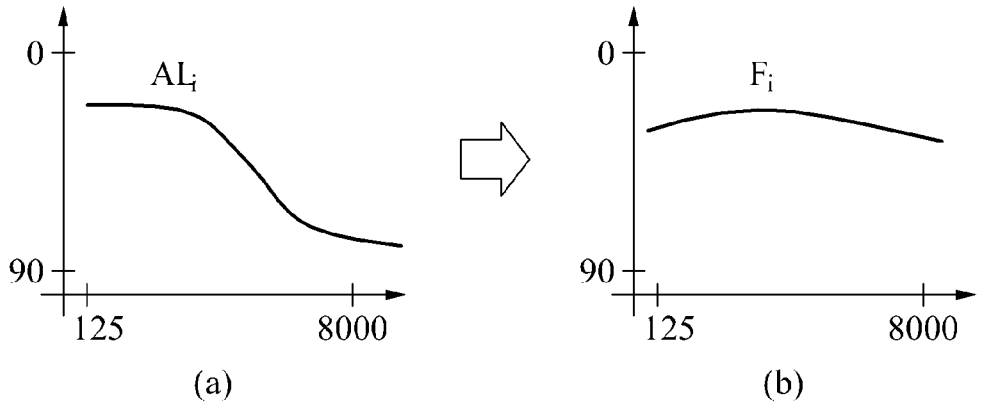
Figure 3C:
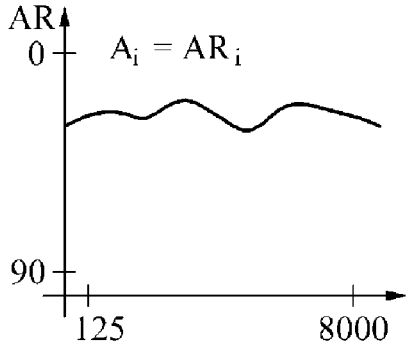
Figure 3D:
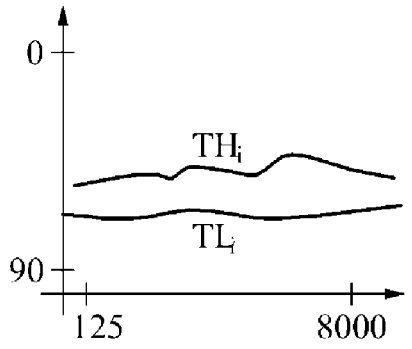

Referring to FIGS. 3B to 3D, a unit of a vertical axis of the graph is a dB indicating an auditory threshold while a unit of a horizontal axis of the graph is a hertz (Hz) indicating a frequency band of an audio signal.

Graph (a) of FIG. 3B illustrates the hearing characteristics of a first ear of a user before compensation by the monaural hearing device. In graph (a) of FIG. 3B, the hearing characteristics of the first ear to which the monaural hearing device is fitted before the compensation indicates that the auditory threshold is lower around 8000 Hz. Thus, in comparison to graph (b) obtained after compensation, graph (a) demonstrates that the auditory threshold of the user is increased according to an increase in the frequency band of the audio signal due to the compensation. Therefore, when the hearing characteristics are not compensated, that is when the user is not using the hearing device or when the hearing device is in an off state, the first ear may perceive only high intensity audio signals as the frequency band is increased.

Graph (b) of FIG. 3B illustrates hearing characteristics of an ear after compensation. That is, the audiogram was obtained from an ear that is wearing an operating monaural hearing device. In an example, the monaural hearing device generates a volume fitting table and adjusts an amplification gain according to the volume fitting table. Accordingly, while the monaural hearing device is on, the ear wearing the monaural hearing device may perceive low intensity audio signals even at a high frequency band.

FIG. 3C illustrates hearing characteristics of the other ear, that is the second year not wearing the monaural hearing device. For the user illustrated in FIG. 3C, the auditory threshold is not uniform for frequency band of the entire hearing range. Therefore, the second ear for which a monaural hearing device is not fitted may not be capable of perceiving an audio signal in a particular frequency band, while the second ear may be capable of perceiving an audio signal of the same intensity at another frequency band.

FIG. 3D illustrates a detection threshold range for detecting a direction of a source of the audio signal. In this example, the monaural hearing device may extract the detection threshold range from a database. For example, the monaural hearing device may extract a minimum detection threshold value based on at least one of an audiogram with respect to the first ear wearing the monaural hearing device and an audiogram with respect to the second ear that is not wearing the monaural hearing device. In addition, the monaural hearing device may extract a maximum detection threshold value based on an MCL. In this example, the monaural hearing device may extract the detection threshold range from the database, in consideration of an age, a gender, and the like, of the user. When a level difference per frequency band is within the detection threshold range, the monaural hearing device may set the volume fitting table as a directivity fitting table, and adjust the amplification gain according to the directivity fitting table. When the level difference per frequency band is beyond the detection threshold range, the monaural hearing device may adjust the volume fitting table so that the level difference per frequency band is included in the detection threshold range. For example, in the event that the level difference per frequency band is smaller than the minimum detection threshold value, the monaural hearing device may adjust the volume fitting table so that the level difference per frequency band becomes larger than the minimum detection threshold value. Also, in the event that the level difference per frequency band is larger than the maximum detection threshold value, the monaural hearing device may adjust the volume fitting table so that the level difference per frequency band becomes smaller than the maximum detection threshold value. The monaural hearing device may set the controlled volume fitting table as the directivity fitting table and control the amplification gain according to the directivity fitting table.

FIGS. 4A and 4B are examples of audiogram and directivity fitting tables according to a binaural hearing device.

Referring to FIG. 4A, an upper table includes an audiogram with respect to a left ear and an audiogram with respect to a right ear according to a frequency band. Numerical values indicated in the audiograms are auditory thresholds of a user at the left ear and at the right ear. When comparing the audiogram with respect to the left ear with the audiogram with respect to the right ear, as the frequency band is increased, the auditory threshold of the left ear is higher than the auditory threshold with respect to the right ear. This means that an audio signal perceivable by the right ear may not be perceived by the left ear.

A lower table shows a directivity fitting table with respect to the left ear. In the directivity fitting table with respect to the left ear, a horizontal axis indicates an intensity of the audio signal perceived by the right ear while a vertical axis indicates an intensity of the audio signal perceived by the left ear.

The binaural hearing device may generate a volume fitting table using the head shape information and the audiograms with respect to the left ear. In an example, the binaural hearing device may calculate WDRC information using the audiogram with respect to the left ear, and generate a first volume fitting table, that is, the volume fitting table with respect to the left ear, using the WDRC information. The binaural hearing device may calculate the level difference per frequency band of the audio signals perceived by both ears using the first volume fitting table and a second volume fitting table which is a volume fitting table with respect to the right ear. In this example, the second volume fitting table may be generated using the audiogram with respect to the right ear. The binaural hearing device may extract the detection threshold range based on the audiograms with respect to both ears.

When the level difference per frequency band is within the detection threshold range, the binaural hearing device may set the first volume fitting table as a first directivity fitting table that is a directivity fitting table with respect to the left ear, and adjust an amplification gain of a left hearing device according to the first directivity fitting table.

When the level difference per frequency band is beyond the detection threshold range, the binaural hearing device may adjust the first volume fitting table so that the level difference per frequency band is included in the detection threshold range. The binaural hearing device may set the first volume fitting table as the first directivity fitting table as in the lower table.

Referring to FIG. 4B, the directivity fitting table with respect to the right ear is shown. In this example, the binaural hearing device may calculate the level difference per frequency band using the second volume fitting table, which is the volume fitting table with respect to the right ear, and the first directivity fitting table, which is the directivity fitting table with respect to the left ear expressed in table (b) of FIG. 4A. The binaural hearing device may extract the detection threshold range based on the audiograms with respect to both ears and control the second volume fitting table so that the level difference per frequency band is included in the detection threshold range. The binaural hearing device may set the controlled second volume fitting table as the second directivity fitting table, which is the directivity fitting table with respect to the right ear as illustrated in FIG. 4B. The binaural hearing device may adjust an amplification gain of a right hearing device according to the second directivity fitting table.

Figure 5:
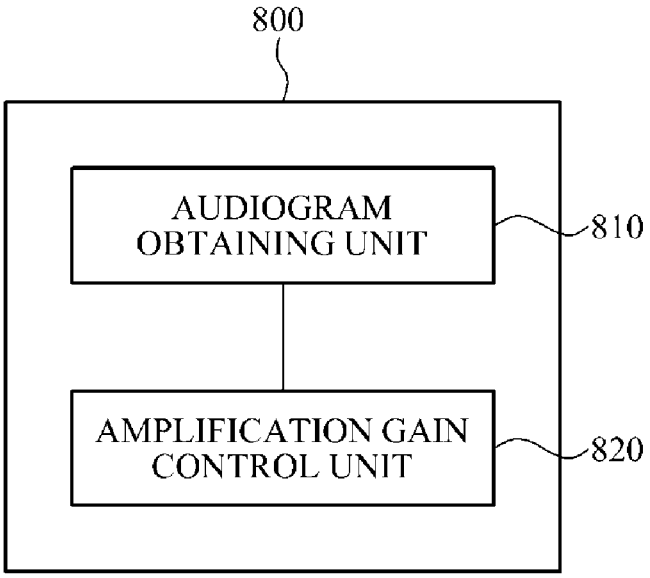
FIG. 5 is a block diagram illustrating an example of a monaural hearing device.

FIG. 5 is a block diagram illustrating an example of a monaural hearing device 800.

Referring to FIG. 5, the monaural hearing device 800 includes an audiogram obtaining unit 810 and an amplification gain control unit 820.

The audiogram obtaining unit 810 may obtain audiograms with respect to both ears. The audiograms may include an audiogram with respect to an ear wearing the monaural hearing device 800 and an audiogram with respect to an ear not wearing the monaural hearing device 800. In this example, obtaining audiograms may refer to obtaining digital data that pertains to the audiograms of ears.

The amplification gain control unit 820 may control an amplification gain using the audiograms with respect to both ears. The monaural hearing device 800 may further include a microphone (not illustrated) and an amplifier (not illustrated).

The foregoing description with reference to FIGS. 1 to 4B is applicable to various features of the monaural hearing device 800. Thus, a detailed description thereof will be omitted for conciseness.

Figure 6:
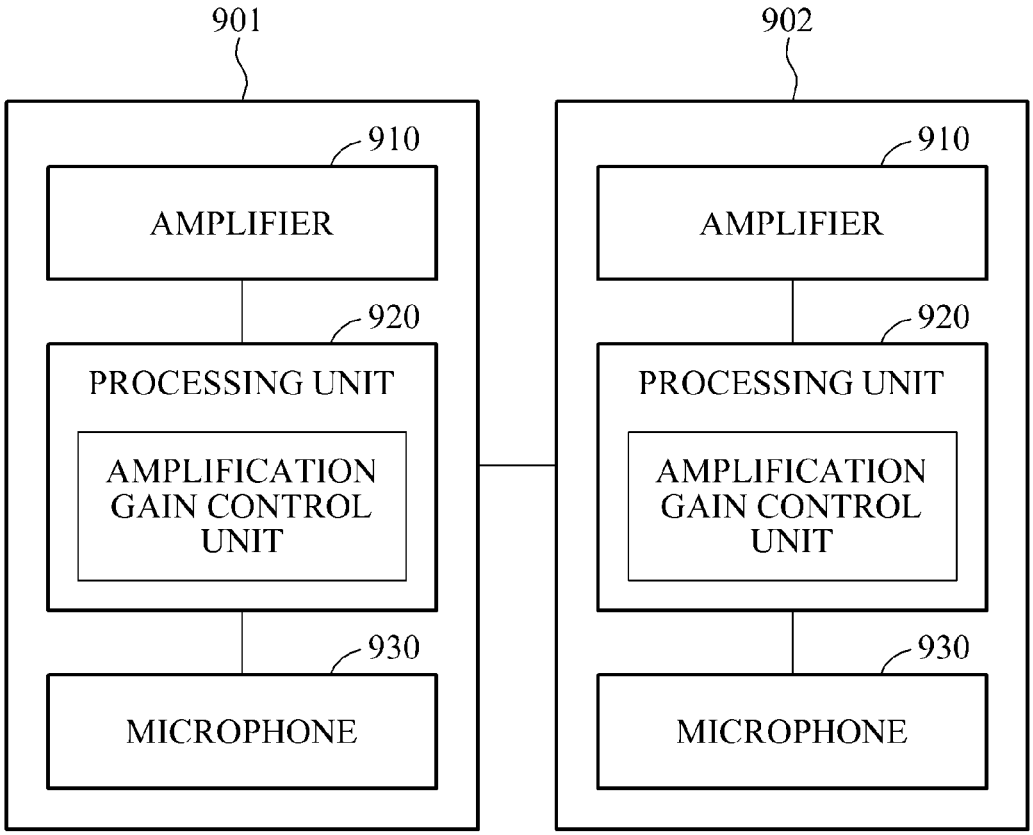
FIG. 6 is a block diagram illustrating an example of a binaural hearing device.

FIG. 6 is a block diagram illustrating an example of a binaural hearing device. The binaural hearing device has a first unit 901 and a second unit 902. Each of the first unit 901 and the second unit 902 include an amplifier 910, a processing unit 920, and a microphone 930. The first unit 901 and the second unit 902 may exchange information via a wired or wireless communication. Further, in other examples, the processing unit 920 may be present in only one unit, or be placed outside of the first unit 901 and the second unit 902. The amplifier 910 may amplify an auditory signal received by the microphone 930 based on the processing performed by the processing unit 920. The processing unit 920 may include an amplification gain control unit. The amplification gain control unit may communicate with an audiogram obtaining unit that is configured to obtain audiograms. The binaural hearing device may have two separate amplification gain control units for each unit, or may have one amplification gain control unit for both the first and the second units. The foregoing description regarding the audiogram obtaining unit and the amplification gain control unit with reference to FIGS. 1 to 5 is applicable to the binaural hearing device illustrated in FIG. 6. Thus, a detailed description thereof will be omitted for conciseness.

The above-described examples may be recorded, stored, or fixed in one or more non-transitory computer-readable media that includes program instructions to be implemented by a computer to cause a processor to execute or perform the program instructions. The media may also include, alone or in combination with the program instructions, data files, data structures, and the like. The program instructions recorded on the media may be those specially designed and constructed, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations and methods described above, or vice versa.

The units described above may be implemented using hardware components and software components. For example, microphones, amplifiers, band-pass filters, audio to digital convertors, and processing devices may be included in the units. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method for fitting a monaural hearing device, the method comprising:

obtaining audiograms of both ears;

obtaining head shape information of a user; and adjusting an amplification gain based on the audiograms of both ears, wherein the audiograms comprise an audiogram of a first ear for wearing the monaural hearing device and an audiogram of a second ear for not wearing the monaural hearing device, and wherein the adjusting of the amplification gain comprises:

generating a volume fitting table using the head shape information and the audiogram of the first ear;

calculating a level difference per frequency band of audio signals perceived by both ears, using the volume fitting table and the audiogram with respect to the second ear;

extracting a detection threshold range based on the audiograms with respect to both ears;

adjusting the volume fitting table so that the level difference per frequency band is included in the detection threshold range in response to the level difference per frequency band being beyond the detection threshold range;

setting the adjusted volume fitting table as a directivity fitting table; and adjusting the amplification gain according to the directivity fitting table.

2. The method of claim 1, wherein the generating of the volume fitting table comprises:

calculating wide dynamic range compression (WDRC) information using the audiogram of the first ear; and generating the volume fitting table using the head shape information and the WDRC information.

3. The method of claim 1, wherein the calculating comprises:

calculating the level difference per frequency band using equal loudness information according to the frequency band.

4. The method of claim 1, further comprising:

setting an operation mode of the monaural hearing device, wherein the adjusting of the amplification gain further comprises adjusting the amplification gain based on the audiograms of both ears in response to the operation mode being a binaural fitting mode.

5. A method for fitting a binaural hearing device, the method comprising:

obtaining audiograms of both ears; and adjusting an amplification gain of a first unit of the binaural hearing device for a first ear based on the audiogram of the first ear and an audiogram of a second ear for wearing a second unit of the binaural hearing, wherein the adjusting comprises generating a first volume fitting table using head shape information and the audiogram of the first ear;

calculating a level difference per frequency band of audio signals perceived by both ears, using the first volume fitting table and a second volume fitting table that is generated using the head shape information and the audiogram of the second ear;

extracting a detection threshold range based on the audiograms with respect to both ears;

adjusting the first volume fitting table so that the level difference per frequency band is included in the detection threshold range when the level difference per frequency band is beyond the detection threshold range;

setting the adjusted first volume fitting table as a directivity fitting table; and controlling the amplification gain according to the directivity fitting table.

6. The method of claim 5, further comprising:

obtaining head shape information of the user.

7. The method of claim 5, wherein the generating of the first volume fitting table comprises:

calculating wide dynamic range compression (WDRC) information using the audiogram of the first ear; and generating the first volume fitting table using the head shape information and the WDRC information.

8. The method of claim 5, wherein the calculating comprises:

calculating the level difference per frequency band using equal loudness information according to the frequency band.

9. The method of claim 5, further comprising:

setting an operation mode of the binaural hearing device, wherein the adjusting of the amplification gain of the first unit comprises adjusting the amplification gain using the audiograms of both ears in response to the operation mode being a binaural fitting mode.

10. A non-transitory computer readable recording medium storing a program to cause a computer to execute the method of claim 1.

11. A binaural hearing device, comprising:

an audiogram obtaining unit configured to obtain audiograms of a first ear and a second ear;

a first unit configured to amplify sound for the first ear;

a second unit configured to amplify sound for a second ear; and an amplification gain control unit configured to adjust an amplification gain of the first unit based on the audiograms of the first ear and the second ear, wherein the amplification gain control unit is configured to adjust the amplification gain by:

generating a first volume fitting table using head shape information and the audiogram of the first ear;

calculating a level difference per frequency band of audio signals perceived by both ears, using the first volume fitting table and a second volume fitting table that is generated using the head shape information and the audiogram of the second ear;

extracting a detection threshold range based on the audiograms with respect to both ears;

adjusting the first volume fitting table so that the level difference per frequency band is included in the detection threshold range when the level difference per frequency band is beyond the detection threshold range;

setting the adjusted first volume fitting table as a directivity fitting table; and controlling the amplification gain according to the directivity fitting table.

12. The binaural hearing device of claim 11, wherein the audiogram obtaining unit is configured to obtain the audiograms from a device storing the audiograms.

13. The binaural hearing device of claim 11, wherein the first volume fitting table is generated based on the audiogram of the first ear and head shape information.

* * * * *